United States Patent [19]

Vulliens

[11] 4,274,317

[45] Jun. 23, 1981

[54] METHOD OF MONITORING A CONTINUOUSLY ADVANCING STRING MATERIAL

[75] Inventor: Philippe Vulliens, Palézieux-Gare, Switzerland

[73] Assignee: Baumgartner Papiers S.A., Crissier, Switzerland

[21] Appl. No.: 26,905

[22] Filed: Apr. 4, 1979

[30] Foreign Application Priority Data

Jan. 19, 1979 [CH] Switzerland ..... 535/79

[51] Int. Cl.[3] ..... A24C 5/28

[52] U.S. Cl. ..... 83/74; 83/38; 83/71; 83/80; 83/365; 83/318

[58] Field of Search ..... 83/38, 71, 74, 80, 318, 83/332, 365

[56] References Cited

U.S. PATENT DOCUMENTS

| | | | |
|---|---|---|---|
| 3,468,201 | 9/1969 | Adamson et al. | 83/74 |
| 3,490,687 | 1/1970 | Bowman | 83/74 X |
| 3,600,997 | 8/1971 | Schmidt | 83/365 X |
| 3,945,279 | 3/1976 | Boehme et al. | 83/365 X |
| 3,967,518 | 7/1976 | Edwards | 83/365 X |
| 4,168,641 | 9/1979 | Bryant | 83/80 |

*Primary Examiner*—Donald R. Schran
*Attorney, Agent, or Firm*—Ernest F. Marmorek

[57] ABSTRACT

A method of monitoring continuously advancing string material (1) of the kind comprising a continuous alternating succession of string sections, for example a cigarette filter string, of different material and/or structural configuration with regard to cutting the string (1) into identical plugs (7) for checking and correcting the position of each cut. Prior to being cut the string (1) is scanned by a sensor unit (4) which detects the beginning and end of each string section. A device associated with the cutting device (5) generates an output signal to indicate the moment when the string (1) is cut. Between this output signal and the moment at which the sensor unit (4) issues a signal corresponding to the end of the string section to be cut, a measured value is obtained which is independent of the feed into of the string (1) and which is proportioned to the length of the string section between the two signals. This measured value is then compared with a reference value and the operative stroke of the cutting device (5) is adjusted when a certain number of successive measured values deviate in the same direction from the reference value.

24 Claims, 6 Drawing Figures

METHOD OF MONITORING A CONTINUOUSLY ADVANCING STRING MATERIAL

This invention relates to a method of monitoring a continuously advancing string material of the kind comprising a continuous alternating succession of string sections of different material quality and/or structural configuration, in particular but not exclusively a cigarette-filter string, with regard to the cutting of said string into discrete plugs of identical type, each comprising at least two sections of relatively different material quality and/or structural configuration, for the purpose of checking and automatically correctively adjusting the spacing of a severing cut relative to the immediately succeeding different section.

In the manufacture of, for example, cigarette filters it is already known to feed a continuously advancing filter string which consists of a continuous alternating succession of sections of different material quality, e.g. cellulose or acetate fibres, and/or different structural configuration, e.g. chambered or unchambered, to a cutting device which severs the filter string into discrete identical filter plugs, each comprising the length of six individual cigarette filters. At fairly regular intervals sample plugs are picked out from the filter plug thus made and are visually checked by a supervisor as to whether the cut has been made at the right place, and if not, the cutting stroke must be adjusted relative to the rate of feed of the string in order to correct the situation, and in the event of major deviations the faulty filter plug have to be manually sorted out and eliminated. For to-day's high production speeds this is a much too imprecise and uneconomical method.

It is the aim of the present invention to provide a method which reduces or eliminates the above mentioned disadvantages and which affords fully automatic monitoring and corrective adjustment of the cutting stroke.

According to this invention there is provided a method of monitoring continuously advancing string material of the kind comprising a continuous alternating succession of string sections of different material quality and/or structural configuration with regard to the cutting of said string into discrete plugs of identical type each comprising at least two sections of different material quality and/or different structural configuration, for the purpose of checking and automatically correctively adjusting the spacing of a cut made by a severing device relative to an immediately succeeding different section, characterised in that, prior to being cut by the severing device, the continuously advancing string is scanned by a sensor unit which responds to the individual string sections of different material quality and/or structural configuration and detects the start as well as the end of each string section, that at the same time an output signal is generated by a device associated with the severing device to indicate the point in time at which the string is cut, that from the moment at which this output signal appears to the moment at which the sensor unit issues a signal corresponding to detection of the end of the string section to be severed a measured value is obtained which is independent of the rate of feed of the string and which is proportional to the length of the string section between these two signals, said measured value being then compared with at least one predetermined reference value and the operative stroke of the severing device being correctively adjusted when a certain number of successive measured values deviated in the same direction from the predetermined reference value.

The application of the method according to this invention is obviously not confined to the monitoring of a continuously advancing cigarette-filter string but it may also be used for checking, or monitoring other kinds of continuously advancing string material comprising a succession of continuously alternating sections of relatively different material quality and/or structure, as for example in the manufacture of colour cartridges for writing utensils.

Conveniently the output signal which indicates the moment in time at which the string is severed is used as a means for enabling a pulse counter, pulses being fed to said pulse counter at a frequency which is proportional to the rate of feed of the string material, the end of each counting process being determined by the end of the string section to be severed as detected by the sensor unit, and the measured value thus obtained at by means of the pulse counter being compared with the reference value.

Advantageously the output signal of the sensor unit is converted by means of a trigger circuit into a square wave pulse series and the latter is fed into a flip-flop circuit which starts and stops the unit wherein the measured value is produced, the arrangement being such that the flip-flop circuit is set to the operative condition thereof which corresponds to the enabled state of said measured value producing unit by means of the output signal which indicates the moment of severing of the string, whilst the flip-flop circuit is switched over to the other operative condition thereof wherein the measured value producing unit is disenabled, by means of the edge of the square wave pulse series fed thereto which immediately follows the earlier mentioned output signal.

For synchronising the severing stroke with the continuous feed of the string material it is further advisable for producing the output signal which indicates the moment of cutting the string a pulse generator or transducer is connected with the drive of the severing device, said pulse generator delivering for each cut which is performed by the severing device a cutting signal to a memory and a control signal to a pulse counter, and issuing for each revolution of the cutting device drive shaft a certain number of pulses to the unit which produces the measured value, the counting process of the latter unit being enabled by the cutting signal and for synchronisation of the output signal of the memory with the square wave pulse series fed to the flip-flop circuit an output signal is issued to the flip-flop circuit by the memory when a preselected adjustable pulse number has been stored therein, whereby the memory is reset.

It is also advantageous if the measured value which has been determined with the aid of the sensor unit, is compared digitally with a minimum and maximum predetermined reference value corresponding to a predetermined range, measured value which is smaller than the predetermined minimum reference value representing a negative deviation whilst measured value which is larger than the predetermined maximum reference value represents a fault in the positive deviation direction; and conveniently in such an arrangement for each measured value which deviates positively from the predetermined value a positive deviation signal is fed to a first counter which counts the number of such positive deviations whilst for measured value which deviates in the negative direction from the predetermined reference value a negative deviation signal is fed to a second counter which counts the number of such negative deviations. With advantage the first counter issues an output signal after a predetermined number of successively measured positive deviations, e.g. after three or four such deviations, and the second counter issues an output signal after counting a certain number, e.g. three or four, of successive negative deviations, which output signals cause the appropriately corrective adjustment of the cutting point or stroke of the severing device, and each of the two counters starting to count once more from zero after having delivered such output signal.

For achieving rapid, accurate and reliable corrective adjustment of the cutting point it is advisable if the adjustment of the moment in time at which the cut is executed by the severing device is caused by adjustment of the angular position of the cutting blade shaft relative to the angular position of the drive shaft of the feed device of the string material.

In the production of chambered filters it is advantageous if the light beam which is directed through the string at a photo-sensitive cell for the purpose of scanning a chambered filter string is passed through the string in such a way that in a string section which comprises a chamber it passes through that region of the string wherein said chamber extends to the outside of the string and opens towards the exterior.

For making cigarette filters of the kind which comprise two or more filter plugs of relatively different materials, e.g. of cellulose and acetate, e.g. for making the so-called dual filters, it is convenient to arrange for a corresponding fault signal to be stored whenever the sensor unit detects a void between two successive string sections, in response to which cault signal an adjustment of the moment at which the cut is performed by the severing device for the string section containing such a void and subsequently defined by two cuts is blocked and also in response to which stored fault signal an ejector device which is arranged downstream of the severing device as viewed in the direction of stock advancement is actuated with such delay that at least the particular plug wherein the sensor unit has detected a void, and preferably also at least 1 to 3 further plugs preceding the detected faulty plug as well as, preferably, at least 4 to 10 further plugs following the detected faulty plug will be likewise ejected.

For checking, in the production of filter plugs which are composed of different kinds of filter section whether the right kind of section is present in the cutting plane, it is advantageous if the output signal which indicates the moment at which the string is to be severed in the case of alternating string sections of different material quality and/or structure is used to control an evaluator circuit which is electrically connected to the sensor unit and which ascertains whether after string advancement by the distance which is present between the pick-up point of the sensor unit and the cutting plane of the severing unit a string section of the required material quality and/or structure is actually placed in the cutting plane, and if this is not the case, interrupts material advancement or issues a fault signal which controls the ejector device of the elimination of the faulty plugs.

The invention will hereinafter be more specifically described, with reference to the accompanying drawings, wherein.

The invention is hereinafter described by way of example as applied to the monitoring of a continuously advancing cigarette-filter-string consisting of a continuous alternating succession of cellulose and acetate plugs.

Figure 1:
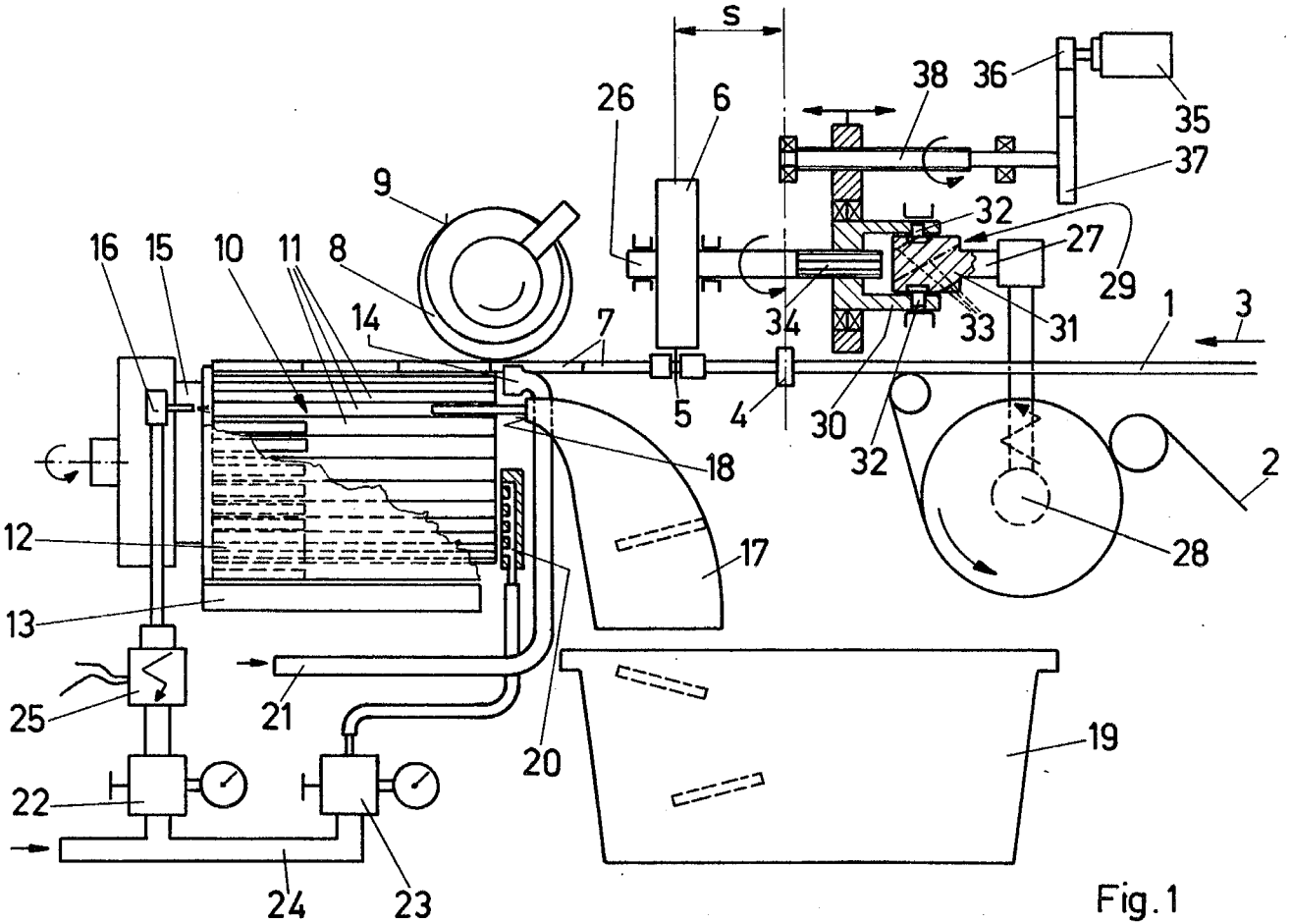
FIG. 1 is a side view of part of a cigarette filter-making machine to show the application of the method of this invention.

As will be seen from FIG. 1, the filter string 1, which is produced in a conventional manner, is conducted by means of an endless conveyor belt 2 forwardly in direction of arrow 3 through an annular sensor head 4, wherein it is scanned or checked for fabrication faults and subsequently severed into individual filter plugs 7 by means of the cutting blade 5 of a severing head 6 which is rotatable about a horizontal axis. A sensor head 4 of this kind is disclosed, for example, in our Swiss application No. 7627/77.

The filter plugs 7 are then successively engaged by a guide wheel 9 which is rotatable about a horizontal axis and comprises a helical groove 8, said guide wheel 9 being driven synchronously with the pick-up cylinder 10 in such a way that the individual filter plugs 7 are introduced accurately into the receiving grooves 11 of the rotating pick-up cylinder by the guide wheel 9 in a per se known manner. The pick-up cylinder 10 is mounted for rotation about a horizontal axis which is normal to the axis of rotation of the guide wheel 9 and is circumferentially provided with grooves 11 extending in its longitudinal direction and adapted to receive the individual filter plugs 7.

The pick-up cylinder 10 is further provided with a guide element 12 which extends in the direction of rotation of cylinder 10 along a cylindrical surface on the outside thereof from the pick-up station to the lower delivery station and prevents the filter plugs 7 from dropping out of their grooves 11, as clearly shown in our Swiss application No. 7626/77. The longitudinal axis of this cylindrical surface coincides with the axis of rotation of the cylinder 10.

At the delivery station which is situated beneath the cylinder 10, the filter plugs 7 which were contained in the grooves 11 fall gravitationally out of the grooves on to a horizontal conveyor belt 13 which revolves endlessly at right angles to the length of the filter string 1 and conducts the filter plugs 7 to a collecting and packing station.

In order to make absolutely sure that at the delivery station all filter plugs 7 are precisely lined up with the conveyor belt 13, a nozzle 14 which delivers an air jet effective in the direction of advancement of the filter plugs is provided on the front side of the pick-up cylinder 10 immediately behind the pick-up station as viewed in the direction of cylinder rotation, so that the air jet which is directed by said nozzle 14 at the end faces of the filter plugs 7 will securely conduct all filter plugs 7 which are introduced into the grooves 11 of the cylinder 10 towards the left hand side until they hit against the end stop 15 provided on this side in the grooves 11. The air nozzle 14 is comparatively broadly designed and extends at once across several filter plugs 7 contained in the grooves 11 of the pick-up cylinder 10.

Behind the air jet 14 which is provided for lining up the individual filter plugs 7 on the cylinder 10, as viewed in the direction of rotation of the cylinder 10, a further air jet nozzle 16, which works as an ejector jet in the opposite direction to the direction of travel 3 of the filter string 1, is arranged on the opposite front side of the pick-up cylinder 10 with its delivery opening directed at the left hand end faces of the filter plugs 7 which travel past this jet during the rotation of the pick-up cylinder 10. For maximum accuracy in the execution of the ejector process the diameter of the air nozzle 16 is selected to be smaller than the diameter of the grooves 11, and preferably of the smallest possible size in order to produce the finest possible air jet because this is the only way to confine the number of filter plugs which must be ejected on detection of a fault by the sensor head 4 to an acceptable minimum.

For the removal of the reject filter plugs 7 which are ejected from the grooves 11 by means of air jet 16 a reject-removal funnel 17 is provided on the front side of cylinder 10 which is remote from the ejector nozzle 16, the intake opening 18 of said funnel 17 being directed against the entrance side of the grooves 10 and arranged in such a way that reject filter plugs 7 which are blown out of the grooves 11 by the air jet 16 pass into this intake 18 of the removal funnel 17 and are conducted through the latter to a suitable receptacle, e.g. 19.

Since it may happen during the starting and stopping of the ejector air jet 16 that an individual filter plug 7 is pushed to the right in its groove 11 but not fully ejected therefrom, an alignment air jet 20 which spans the entrance ends of several grooves 11 is provided between the ejector nozzle 16 and the delivery station on the right hand side of the cylinder 10, as viewed in the direction of cylinder rotation, this further air jet 20 being directed at the grooves 11 to ensure that all filter rods 7 securely abut the left end stop of the grooves 11 prior to arriving at the delivery station and are thus properly lined up relative to the conveyor belt 13.

The air nozzle 14 is supplied via hose 21, for example with the fan air from the motor of the cigarette filter making machine.

The two air jets 16 and 20 are supplied with compressed air via a pneumatic hose 24 by means of adjustable pressure reducing valves 22 and 23. For selective operation of the ejector jet 16 a solenoid valve 25 is provided between the latter and the pressure reducing valve 22, said solenoid valve 25 being electromagnetically actuated by means of a control circuit hereinafter more particularly described and controlled by the sensor head 4.

For adjusting the point in time at which the severing device executes the cutting stroke relative to the filter plugs which are to be severed in the continuously advancing filter string 1, the cutting head 6 is operatively connected by a two-part transmission shaft 26, 27 with the drive 28 for string advancement. Between the first and second parts 26, 27 of this transmission shaft there is provided an adjusting link 29 rotating with the latter for varying the angular position of the two shaft parts 26, 27 relative to each other and within certain limits. This adjusting link 29 comprises two axially aligned and relatively axially slidable parts 30 and 31 one of which is provided with guide elements 32 which engage in helical grooves 33 provided in the other part 31. The adjusting link part 31 may also be integral with the transmission shaft part 27. The adjusting link part 30 is axially slidably and drivingly connected via V-splining 34 with the associated transmission shaft part 26.

Sliding adjustment of the axially slidable part 30 is obtained by means of a reversible adjusting motor 35, which engages with the part 30 by means of the meshing gears 36, 37 and spindle 38.

The arrangement which is hereinafter described by way of example shows the invention as applied to the checking and monitoring of a continuously advancing cigarette filter string consisting of a continuously alternating succession of cellulose and acetate filter plugs; it will be appreciated, however, that the arrangement may naturally also be used for monitoring a cigarette filter string consisting of a single fibre string which is provided with filled, e.g. granulate-filled, chambers.

Figure 2:
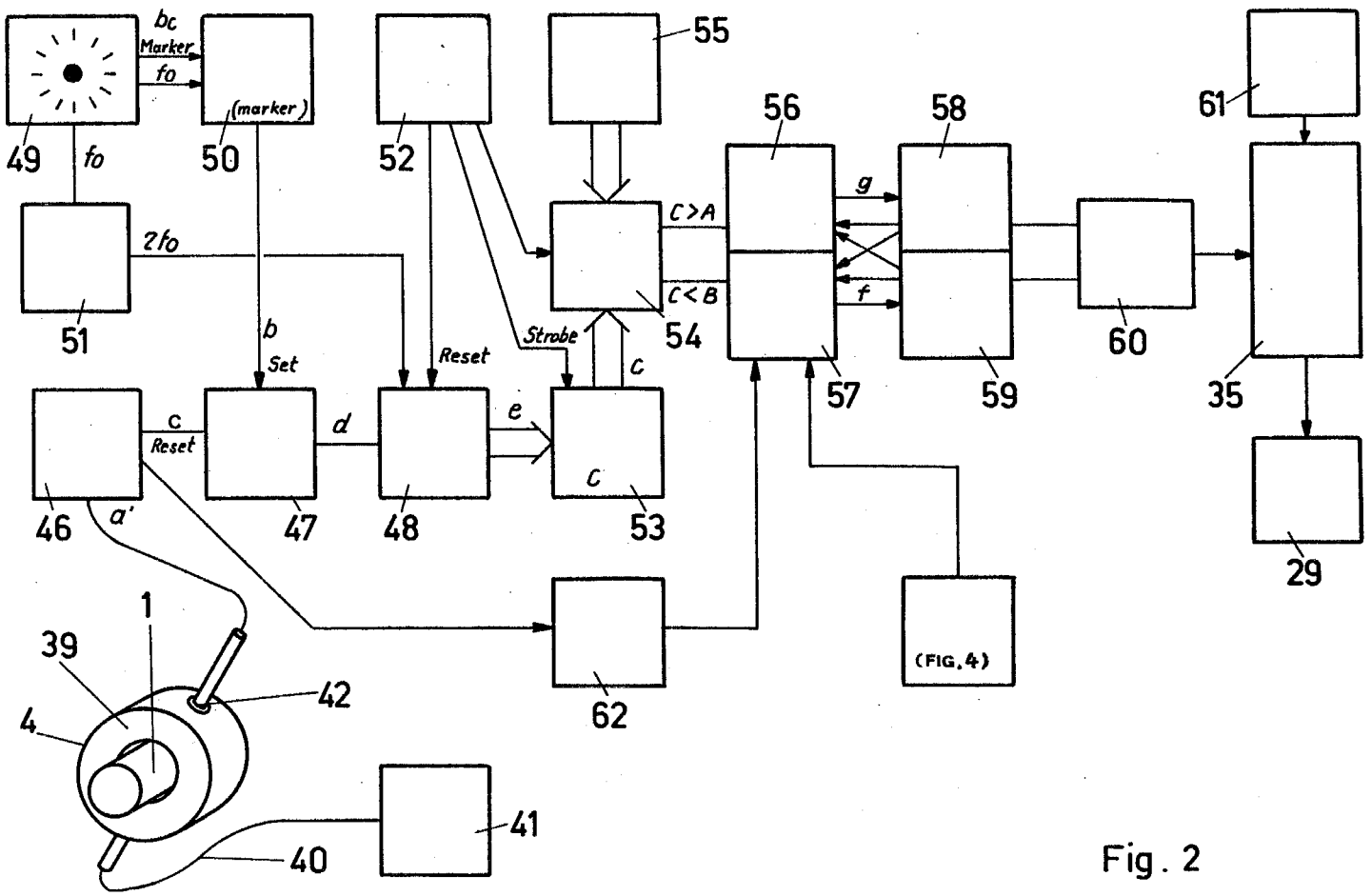
FIG. 2 is a block circuit diagram of one example of an arrangement for the execution of the method according to this invention, as applied to the production of cigarette-filter plugs.

As shown in FIG. 2, the filter string 1, which advances continuously in direction 3, is optically scanned prior to being cut up by the severing device 6, and the beginnings and ends of the individual filter plugs are detected by means of an optical sensor unit 4 which responds to and detects the individual string sections of different material quality. The sensor unit 4 comprises a sensor head 39 which surrounds the filter string 1 without clearance and is connected via an optical fibre 40 to a light source 41 for passing a light beam diametrally through the filter string 1, as well as being associated with a photo-sensitive cell 42 fitted in the sensor head 39 for sensing the light which emerges from the filter string 1 on the opposite side to the point at which the light enters into the string. The light source 41 comprises a conventional halogen lamp whereof the light rays are concentrated by an hyperbolic mirror and passed through an infrared filter to filter out infrared light before being introduced into the optical fibre 40 in order to avoid harmful heat application to the optical sensor elements. The sensor head 39 is made of a non-reflecting synthetic resin material in order to avoid undesirable light reflections in the annular filter string guide channel which could falsify the measured results.

Figure 3:
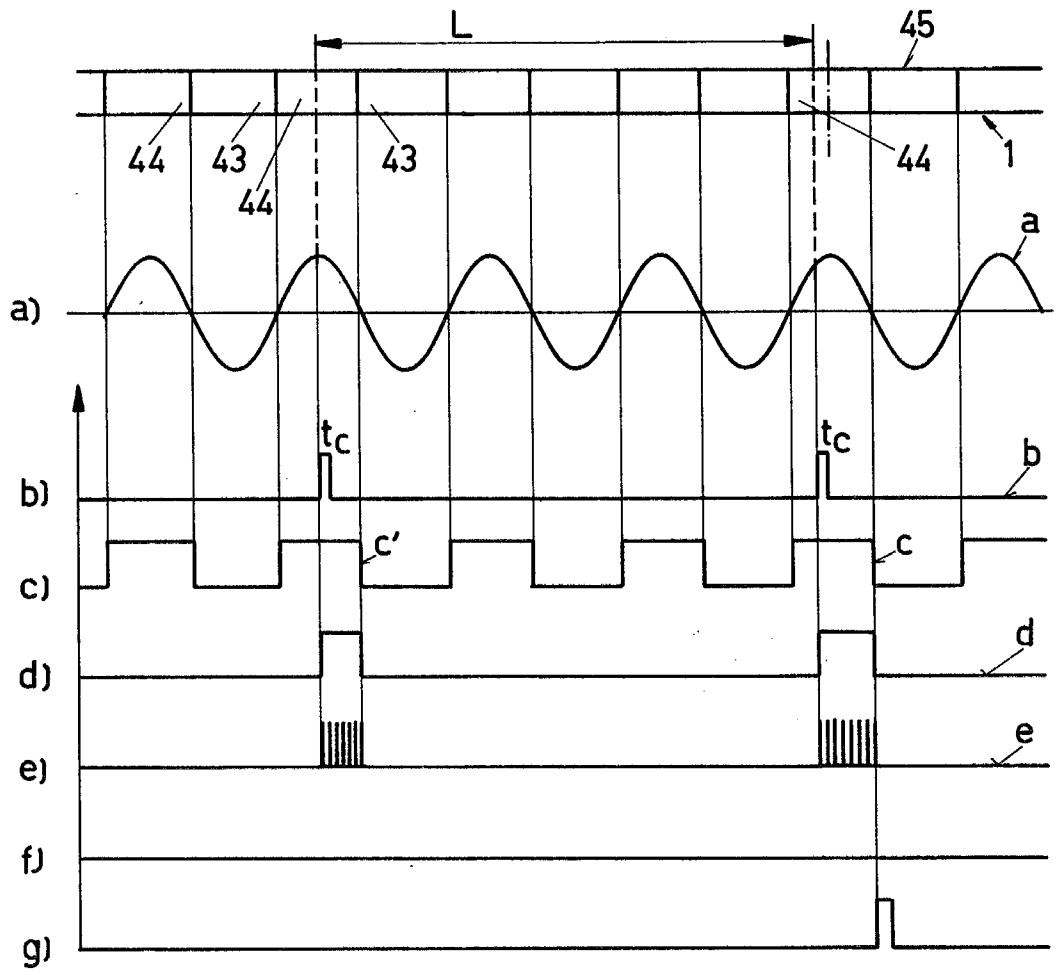
FIG. 3 is a time-plot representing various simultaneously occurring signals in the system according to FIG. 2.

As will be observed from the top line of FIG. 3, the monitored filter string 1 in this example consists of a continuously alternating succession of cellulose and acetate plugs 44, 43, encased in conventional manner in a continuous outer paper sleeve 45. In this type of cigarette filter each individual filter attached to a single cigarette consists of one half cellulose and one half acetate filter mutually rigidly connected by means of the enveloping outer sleeve 45. The cigarette filter makers supply the filters to the cigarette manufacturers in the form of filter plugs 7 which have the length L of six individual cigarette filters. In order to provide each cigarette with precisely the same identical filter it is of utmost importance that the cellulose plugs 44 are in each case cut through their precise middle since otherwise the ratio of cellulose to acetate and thus the filtering effect will vary considerably from filter to filter.

Now the method which is hereinafter more specifically described permits the precise monitoring of such a filter string 1 as well as automatic corrective control of the severing device 6 which cuts the string 1 up into individual identical filter plugs.

The output signal a' of the photo-sensitive cell 42 is amplified in unit 46 and the amplified output signal a (FIG. 3) converted by means of a trigger circuit into a square-wave pulse series c. This square-wave pulse series c is fed to a flip-flop circuit 47 which enables and disenables a pulse counter 48 which produces the measured value, the flip-flop circuit 47 being set by an output signal b which indicates the point in time $t_c$ at which the filter string 1 is severed. The set condition is the operative condition of the flip-flop 47 which corresponds to the enabled condition of the measured-value producing pulse counter 48. The edge c' of the square wave pulse series c immediately following the first mentioned output signal b switches the flip-flop circuit 47 over to the other operative condition thereof wherein the pulse counter 48 which produces the measured value is disenabled.

For producing the output signal b which indicates the point in time $t_c$ of cutting the filter string 1, which is completely independent of the rate of feed of the filter string 1, a pulse generator 49 is connected with the drive shaft 26 of the severing head 6. This pulse generator 49 issues for every revolution of the cutting head drive shaft 26, that is to say, for every cut which is preferred by the severing device, a cutting signal $b_c$ which is fed to a memory which forms part of a unit 50 and is also fed as a control signal to a pulse counter likewise forming part of the unit 50, and for each revolution of the drive shaft 26 of the severing head 6 200 pulses ($f_o$) are fed to the pulse counter in unit 50 which is controlled by the cutting signal $b_c$ and the counting process of which is triggered by the cutting signal $b_c$. For synchronising the output signal of the memory in unit 50 with the square wave pulse series c fed to the flip-flop circuit 47, the memory issues at the end of an adjustable preselected number of pulses which depends on the length L of the filter plug 7 to be made, an output signal b to the flip-flop circuit 47 whereupon the memory is reset.

For maximum measuring accuracy the pulse series $f_o$ which is produced by means of the pulse generator 49 is additionally fed to a frequency multiplier 51 which doubles the frequency of pulse series $f_o$, and this higher frequency pulse series $2f_o$ is then fed to the pulse counter 49 which determines the measured value. The latter counter is in each case reset to zero with the aid of a synchronising pulse generator or timer 52.

The measured value c which is ascertained with the aid of pulse counter 48 is then stored in a memory 53 and when the latter is strobed by a timing pulse from the timer 52 transmitted to a binary comparator 54 which is likewise controlled by the synchronising timer 52. Because of the synchronising action of the timer 52 the circuits, 48, 53 and 54 controlled by the latter are also unaffected by the rate of feed of the filter string 1.

In the binary comparator 54 the measured value C is digitally compared with a minimum reference value B and with a maximum reference value A, a measured value C smaller than the predetermined minimum reference value B representing a fault in the sense of negative deviation whilst measured value C which is larger than the predetermined maximum reference value A represents a fault in the sense of positive deviation. The reference values A and B are stored in a unit 55 which is electrically connected with the binary comparator 54 and can be varied in accordance with the desired degree of accuracy to be observed in the production of the filters.

From the binary comparator 54 a positive deviation fault is fed to a first counter which counts the number of such positive deviations whilst a negative deviation fault is fed to a second counter 57 which counts all negative deviations. The positive and negative deviation signals are then also fed to a fault-level scanner unit 58 which in the event of a positive deviation signal following a negative deviation signal or vice versa resets both counters 56 and 57 to zero because in that event the direction of corrective adjustment for the cutting blade 5 is changed.

In order to avoid corrective adjustment of the cutting blade position for each and every detected deviation which in combination with the normally tolerated variations in the lengths of the plugs 43 and 44 could lead to a lasting correction of the cutting blade position, the counters 56 and 57 are arranged in such a way that the first counter 56, after, for example, three successive positive deviations and the second counter 57 after, for example, three successive negative deviations counted therein each issue an output signal g, or f respectively, to a timer and controller unit 59, 60 connected with the fault level scanning unit 58. In the illustrated example according to FIG. 3, no negative deviation signal f, but a positive deviation signal g will be issued. The timer and controller unit 59, 60 which is associated with the fault incidence or fault-level scanning unit 58 will on arrival of an output signal from counter 56 or 57 produce a certain switch-on period for the reversible adjusting motor 35 in the direction of rotation thereof which is the corrective one for the cutting time. In other words, the adjusting motor 35 will be switched on for a specified and constant period in the corrective sense of rotation every time three deviations are detected and counted which are in the same direction of deviation. The adjusting link 29 is further associated with a sensor device 61 which when the adjusting link 29 has reached one of the end stops of its operative travel distance makes it impossible for the motor 35 to be switched on in the direction which would correspond to further displacement of the adjusting link 29 in the same direction beyond said end stop, and issues a signal to stop the entire machine.

The unit 46 which is connected with the photosensitive cell 42 in the sensor head 39 is further associated with an evaluator circuit 62 which in the event of an empty sensor head 39, that is to say, when no filter string 1 is engaged in the latter, influences the counters 56 and 57 in such a manner that there will be no adjustment of the point in time at which the severing device executes the cutting stroke.

Figure 4:
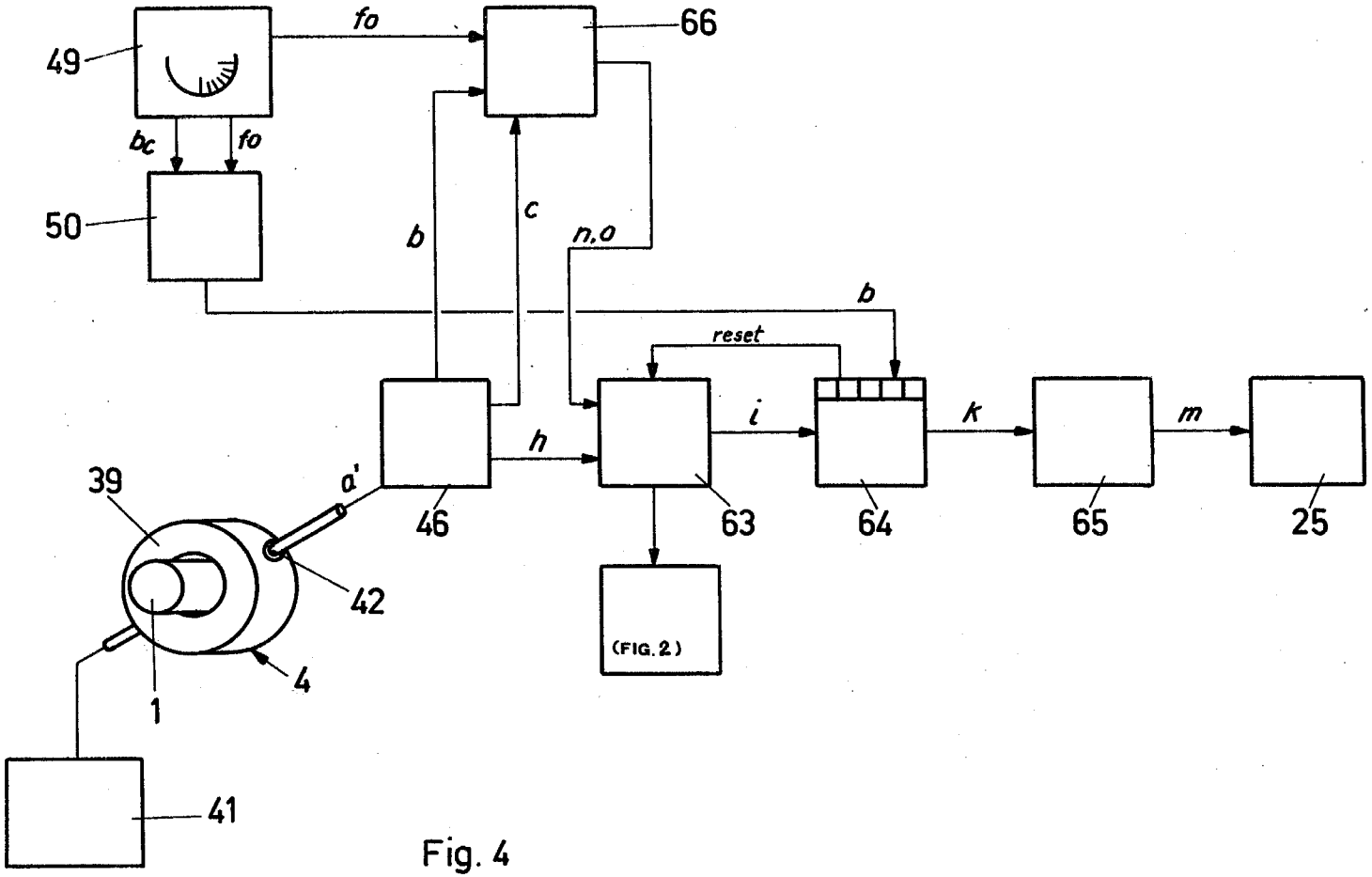
FIG. 4 is a block circuit diagram of an example of a further development of the system diagrammatically represented in FIG. 2.
Figure 5:
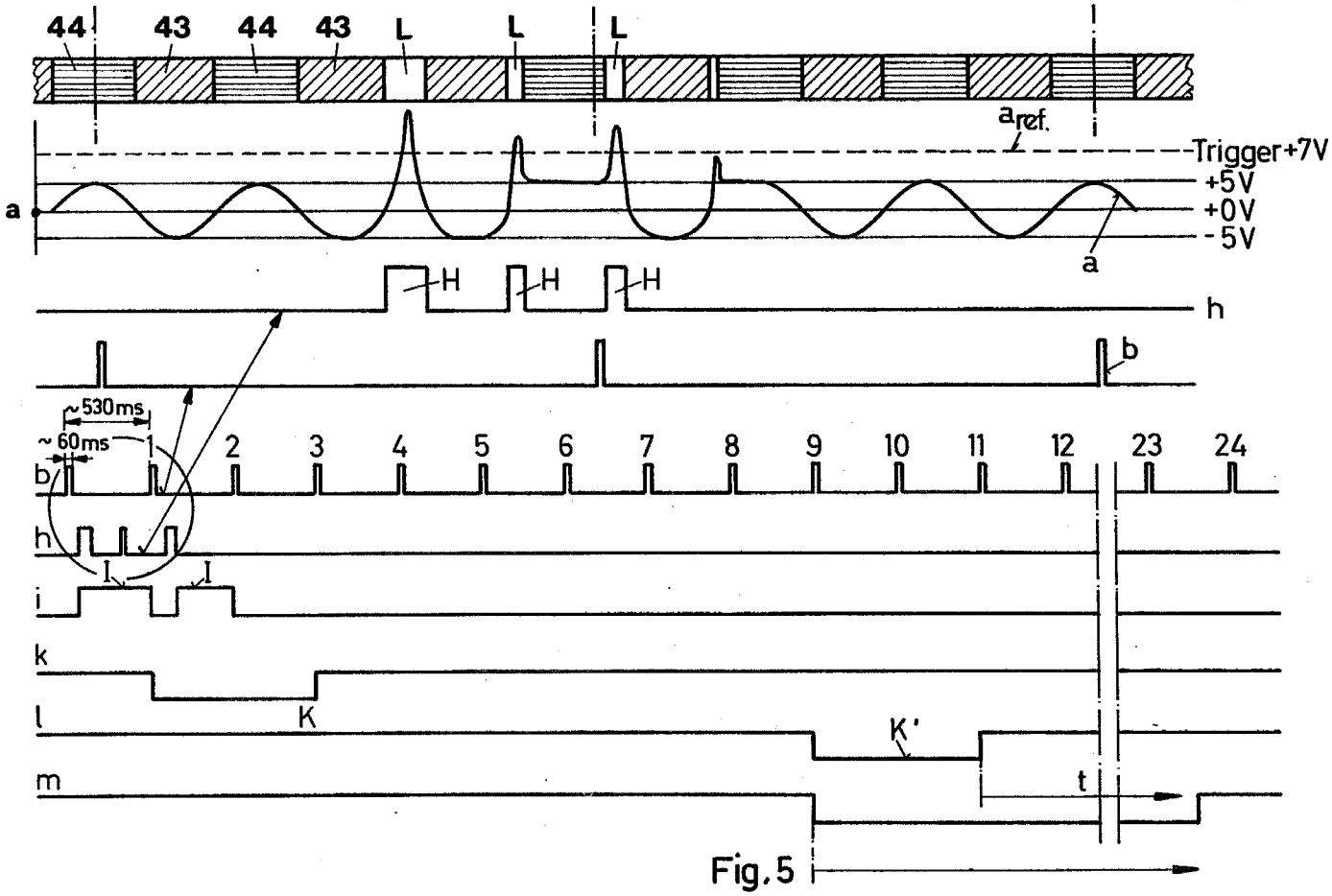
FIG. 5 is a time-plot showing various simultaneously occurring signals in the embodiment shown in FIG. 4 for checking the advancing string for faults.

If it is desired to monitor a string 1 which consists of just one material, e.g. acetate fibre, and which is provided with outwardly opening chambers, then an output signal a which can be very easily evaluated may be conveniently obtained by directing the light beam in the sensor head 39 through the string 1 in such a way that it will pass through the open chamber mouth in the chambered section of the string, that is to say, the light beam passes through the material of the string only between the chamber bottom and the outside wall, i.e. across a distance of approximately 2 mm, so that in this region the intensity of the light beam incident on photosensitive cell 42 is only very slightly weakened by the material of the string. In practice it may happen, for example in the manufacture of a filter string 1 which comprises cellulose (44) and acetate (43) plugs, that, as shown at the top of FIG. 5, some of the filter plugs are completely absent and/or that two successive plugs 43, 44 do not actually abut one another, so that there are voids in the filter string 1 through which the light beam which is directed through the string 1 in the sensor head 39 passes virtually unimpeded, that is to say, the light intensity is weakened only by the outer paper envelope 45, with the result of a strong variation in amplitude for the output signal a' from the photo-sensitive cell 42. Practice has shown that even gaps of 1 mm and under between successive plugs can still be detected prefectly with the aid of the circuit system shown in FIG. 4 associated with the circuit of FIG. 1 as indicated in the latter figure.

The output signal a' from photo-sensitive cell 42 is amplified in unit 46 and the amplified signal a (FIG. 5) compared with a reference voltage $a_{ref}$. If this reference voltage $a_{ref}$ is exceeded owing to the presence of one or more voids in the string, a signal series h indicating the void L by square wave pulses is produced by means of a trigger and fed to a flip-flop circuit 63. By means of this signal series h the flip-flop circuit 63, as will be seen by the flip-flop output signal i (FIG. 5) provided it is not already in this operative condition, is switched by the presence of an impulse H representing such a gap L to such an operative state thereof as to issue a fault signal I to be stored in a shift register 64. Since in the illustrated example there are eight filter plugs 7 between the scanning head 4 and the ejector jet 16 of the ejector device 10, 16–19 and 25, the shift register 64 has eight memory stages for storing in each stage either "good" or "bad" information for an associated one of these eight filter plugs 7. The output signal b, which is produced by means of the pulse generator 49 and unit 50 of the circuit system shown in FIG. 2 to indicate the point in time at which the filter string 1 is severed, is fed as a shift pulse to the shift register 64 and at the same time the flip-flop circuit 63 is reset to its initial condition. Any 'bad' information K contained in the output signal of the shift register 64 will be stored in the following unit 65 for as long as at least one more filter plug is present between the faulty filter plug 7 and the ejector jet 16 of the ejector unit. Then the thus time-delayed 'bad' information K' is held in unit 65 for the time required for the advancement of, say, eight filter plug lengths, in order to obtain an ejection control signal m which energises the solenoid valve 25 associated with the ejector jet 16 in such a fashion that additionally to the filter plug 7 which contained the fault or faults L detected by the sensor unit, at least one other filter rod preceding this faulty filter plug and also at least eight further filter plugs following said faulty filter rod will also be ejected because, as a general rule, if there is a gap L in one filter rod several following filter rods are liable to present the same fault.

The flip-flop circuit 63 is further associated with the circuit system shown in FIG. 2 in such a way that in the presence of a fault signal I the adjustment of the cutting time for the severing device is blocked for the part of the filter string which contains the said void L and which is later defined by two cuts.

Furthermore, the circuit is arranged in such a way that for a certain number of fault signals L occurring after successive cuts the feed or advancement of the filter string 1 is interrupted because in that event it will be necessary for an operator to check the machine.

In a string where cellulose plugs 44 alternate with acetate plugs 43 it is important that the severing cut should always be made through the cellulose plugs 44. To this end the output signal b which indicates the point in time at which the filter string 1 is cut is used as an input for an evaluator circuit 66 which is electrically connected with the sensor unit 4 and which detects whether after advancement of the filter string 1 by the distance s between the sensor head 4 and the cutting plane of the severing head 6 (FIG. 1) the cellulose plug 44 will be contained in the said cutting plane, falling which the filter string feed is interrupted or a fault signal issued to control the ejector device for rejecting the faulty filter plugs 7.

Figure 6:
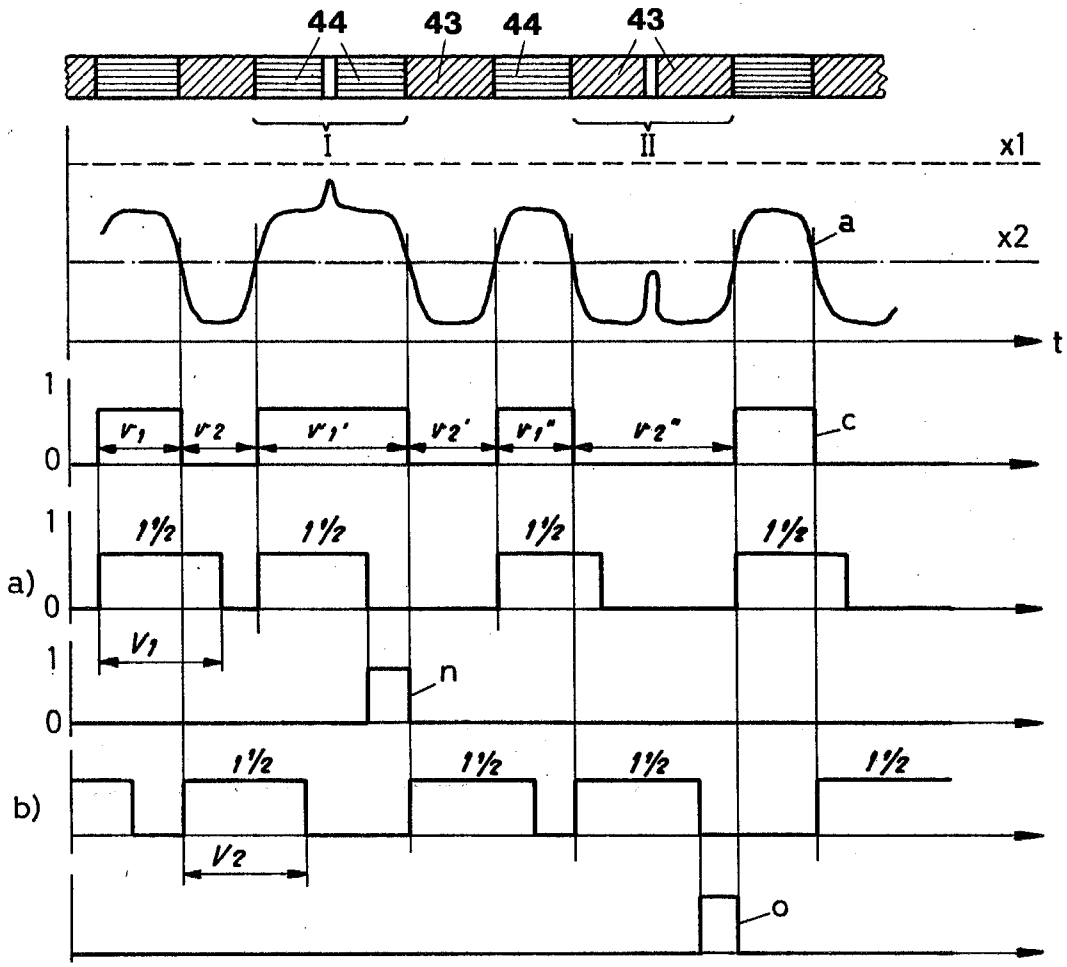
FIG. 6 is a time-plot representing various simultaneously occurring signals in a further development of the system shown in part of FIG. 4 for checking the continuously advancing string for wrongly associated plug-like filter sections.

In filter strings which consist of alternating plugs of different materials, that is to say, of cellulose plugs 44 and acetate plugs 43, faults in the filter string may arise from the absence of a cellulose plug 44 (fault I) and/or of an acetate plug (43 (fault II) in the regularly alternating sequence of plugs, as shown at the top of FIG. 6. The output signal a' of the photo-sensitive cell 42 which is amplified in unit 46, then produces the output signal a shown in FIG. 6 and after the trigger of unit 46 the square wave pulse cellulose-acetate signal c. The leading and trailing edges of each square wave pulse in each case reflect the distance between the start and the end of a string section of the same material quality.

The measured values $v_1$, $v_1'$, $v_1''$, etc. for the acetate portions and $v_2$, $v_2'$, $v_2''$, etc. for the cellulose portions are compared in the comparator and evaluator circuit 66 with a predetermined comparative or reference value $v_1$ for the acetate portions and $v_2$ for the cellulose portions, and in the illustrated example these comparative or reference values $V_1$ and $V_2$ correspond to $1\frac{1}{2}$ times the length of one plug.

If an actual value is greater than the associated comparative reference value, the comparative and evaluator circuit 66 will issue the output signal n for fault I and output signal O for fault II, and these signals n and o are used in analogous fashion to the signal h which represents the presence of a void L for activating the flip-flop circuit 63 which precedes the shift register 64 in order to actuate the ejector device which follows the severing device 6 in such a way that at least the filter plug 7 which has been detected as being faulty will be rejected.

In FIG. 6 the amplified output signal is shown at a and $x_1$ is the trigger or response threshold of the trigger which in the presence of sufficiently large gaps L creates square wave pulses H (FIG. 5) whilst $x_2$ is the trigger threshold of the trigger which creates the square-wave pulse cellulose-acetate signal c.

I claim:

1. In a method of monitoring a continuously advancing string material of the kind comprising a continuous alternating succession of string sections of different material quality and/or structural configuration with regard to the cutting of said string into discrete plugs of identical type, each comprising at least two sections of different material quality and/or different structural configuration, for the purpose of checking and automatically correctively adjusting the spacing of a cut made by a severing device relative to an immediately succeeding different section, comprising the steps of scanning the continuously advancing string before cutting it by a sensor unit which responds to individual string sections of different material quality and/or structural configuration;

detecting the start as well as the end of each string section;

generating concurrently an output signal by a device associated with the severing device to indicate the point in time at which the string is cut;

obtaining, from the moment at which the output signal appears, to the moment at which the sensor unit issues a signal corresponding to detection of the end of the string section to be severed, a measured value which is independent of the rate of feed of the string, and which is proportional to the length of the string section between the two signals;

comparing the measured value with at least one predetermined reference value; and correctively adjusting the operative stroke of the severing device when a certain number of successive measured values deviate in the same direction from the predetermined reference value.

2. A method according to claim 1, further comprising the steps of providing a pulse counter which is enabled in its counting state by the output signal which indicates the point in time at which the string is severed, feeding the pulse counter with pulses at a frequency which is proportional to the rate of feed of the string material, determining the end of each counting process by the end of the string section to be severed as detected by the sensor unit; and comparing the measured value obtained by means of the pulse counter with the predetermined value.

3. A method as defined in claim 1, further comprising the steps of converting the output signal of the sensor unit by means of a trigger circuit into a square-wave pulse series, feeding the square-wave pulse series to a flip-flop circuit which starts and stops the unit which produces the measured value, switching the flip-flop circuit to the operative condition thereof which corresponds to the enabled state of the unit producing the measured value by means of the output signal which indicates the point in time at which the string is severed, and utilizing the edge of the square wave pulse series fed to the flip-flop circuit which follows immediately upon the previously mentioned output signal, for causing the flip-flop circuit to be switched over to the other operative state thereof in which the unit which produces the measured value is disengaged.

4. A method according to claim 3, further comprising the steps of providing a pulse generator associated with the drive of the severing device and producing the output signal which indicates the point at time at which the string is severed, delivering by the pulse generator for each cut performed by the severing device a cutting signal to a memory and the same signal as a control signal to a pulse counter, and delivering for each revolution of the drive shaft a certain number of pulses to the unit which produces the measured value;

enabling the counting process of the measured value unit by the cutting signal;

synchronizing the output signal of the memory with the square wave pulse series fed to the flip-flop circuit by means of issuing from the memory after counting a preselected adjustable number of pulses, an output signal to the flip-flop circuit and resetting the memory.

5. A method in accordance with claim 4, further comprising the steps of additionally feeding the pulse series which is produced by the pulse generator associated with the severing device for each revolution of the drive shaft of the severing device, to a frequency multiplier in which the frequency of the pulse series is at least doubled; and feeding the higher frequency pulse series to the unit which produces the measured value.

6. A method according to claim 1, further comprising the steps of comparing the measured value which is determined with the aid of the sensor unit digitally to a minimum and a maximum predetermined reference value corresponding to a predetermined range, so that a measured value which is smaller than the predetermined minimum value represents a fault in the sense of a negative deviation, and a measured maximum value which is greater than the predetermined maximum value represents a fault in the sense of a positive deviation.

7. A method as defined in claim 6; further comprising the steps of feeding for each measured value which deviates positively from a predetermined value, a positive deviation signal to a first counter which counts the number of such positive deviations, and feeding for each measured value which deviates negatively from a predetermined value, a negative deviation signal to a second counter which counts the number of such negative deviations.

8. A method according to claim 7, further comprising the steps of providing from the first counter, after having counted a given number of successive positive deviations, and by the second counter, after having counted a certain number of successive negative deviations, an output signal causing corrective adjustment of the point in time at which the severing device performs the severing cut, and ordering each of the two counters to start from zero after having provided such an output signal.

9. A method according to claim 8, further comprising the step of setting the first counter to zero when a negative deviation occurs and restoring the second counter to zero in the event of a positive deviation occuring.

10. A method according to claim 1; further comprising the step of performing an adjustment of the point in time at which the severing device performs the cutting stroke, by adjusting the angular position of the cutting blade shaft relative to the angular position of the drive shaft driving the feed device of the string material.

11. A method according to claim 1; further comprising the step of insuring by the sensor unit, in the absence of the string material, that there will be no adjustment made in respect of the point in time at which the severing device performs the cutting stroke.

12. A method according to claim 1; further comprising the steps of scanning a chambered string with the aid of at least one light beam directed through the string to a photosensitive cell, and passing the said light beam through the string in such a way that in a chambered string section it passes through that region of the string wherein the chamber extends to the outside of the string and opens toward the exterior.

13. A method according to claim 1, and further comprising the steps of storing a corresponding fault signal when the sensor unit detects a void between two successive string sections, blocking by reason of the stored fault signal, adjustment of the point in time at which the severing device executes the severing cut, for the string section which contains the void and which is substantially defined by two cuts, and actuating by reason of the stored fault signal, an ejector device which is arranged in succession with the severing device as viewed in the direction of string advancement, with such a time delay that at least the particular plug wherein a void was detected by the sensor unit will be rejected by the ejector device.

14. A method according to claim 13, further comprising the step of rejecting also at least one to three plugs preceeding the faulty plug.

15. A method according to claim 13, further comprising the step of rejecting also at least four to ten plugs following the faulty plug.

16. A method according to claim 13, further comprising the steps of switching on a flip-flop circuit, unless the flip-flop circuit is already in this particular operative state, by means of the void signal into an operative state in which it issues a fault signal to a shift register in which the number of stages corresponds to the number of plug lengths between the sensor unit and the ejector device arranged in succession with the severing device, unless the flip-flop circuit is already in said operative state, the state of each stage corresponding to 'good' or 'bad' information for an associated plug length, feeding the output signal which indicates the point in time at which the string is severed to the shift register and at the same time resetting the flip-flop circuit to its initial state, and using on output of the 'bad' information from the shift register, the output signal representing this information, to control the ejector device in such a way that at least the plug which contains the fault or faults detected by the sensor unit is rejected by the ejector device.

17. A method according to claim 13, further comprising the steps of using the output signal which indicates the point in time at which the string is severed, for controlling an evaluator circuit electrically associated with the sensor unit, ascertaining by the evaluator circuit whether after advancement of the string by the distance between the measuring point of the sensor unit and the cutting plane of the severing device a string section which has the desired material quality and/or structural configuration is contained in the cutting plane; and interrupting same is not so, the feed of the string, by the evaluator unit, or issuing a fault signal to the ejector device for the rejection of the faulty plug.

18. A method as defined in claim 17, further comprising the step of stopping the string in the event of a certain number of fault signals occuring for successive cuts.

19. A method according to claim 16, further comprising the steps of ascertaining the distance between the start and end of a string section of the same material quality and/or structural configuration, by means of the sensor unit;

comparing the measured value thus ascertained in a comparator circuit with a predetermined reference value; and actuating an ejector device which is arranged in succession with the severing device, in such a way that it rejects at least that plug which contains, or those of the plugs which contain, the fault detected by the comparator circuit, if the measured value is larger than the reference value.

20. A method as defined in claim 19, further comprising the step of using the fault signal output of the comparator device, if the measured value is greater than the reference value, in analogous manner to the signal representing a void for controlling the flip-flop circuit which precedes the shift register.

21. A method as defined in claim 1, further comprising the steps of using the sensor unit in such a way that at least one light beam extending in a plane which is at least substantially normal to the longitudinal axis of the string is introduced into the string;

measuring the brightness difference by means of at least one photosensitive device at a point on the outside of the string which is remote from the point at which the light beam is introduced into the string, but at least approximately in the same light-beam containing plane; and evaluating the measured results in an evaluator circuit which is electrically connected to said photosensitive device.

22. A method according to claim 1, further comprising the steps of adjusting the point in time at which the severing device performs the cutting stroke by connecting the cutter blade head of the severing device by means of a two-part transmission shaft to the drive for string advancement, providing between the first and second parts of said transmission shaft an adjusting link rotating with the latter for varying the relative angular position of the two parts of the transmission shaft relative to each other, and within certain limits, providing the adjusting link which comprises at least two axially aligned and relatively slidable parts of which one is provided with guide elements engaging in helical grooves formed in the other part; and axially displacing by adjusting means at least one adjusting link part relative to the second adjusting link part for the purpose of varying the relative angular position of the two parts of the transmission shaft.

23. A method according to claim 22, further comprising the steps of displacing the axially slidable adjusting link part by a reversible adjusting motor; and connecting the like part via V-splining with the associated transmission shaft part.

24. A method as defined in claim 1, wherein the string material comprises cigarette filter material.

* * * * *